United States Patent [19]

Jaffe

[11] Patent Number: 4,509,632

[45] Date of Patent: Apr. 9, 1985

[54] TOKEN AND ACCEPTANCE MECHANISM

[75] Inventor: Myron I. Jaffe, Chestnut Hill, Mass.

[73] Assignee: Sintered Metals, Inc., Boston, Mass.

[21] Appl. No.: 543,384

[22] Filed: Oct. 19, 1983

Related U.S. Application Data

[63] Continuation of Ser. No. 321,721, Nov. 16, 1981, abandoned.

[51] Int. Cl.[3] ..... G07F 7/00

[52] U.S. Cl. ..... 194/4 D; 40/27.5

[58] Field of Search ..... 194/97, 97 A, 97 B, 194/102, 4 F, 4 D, 4 E, 4 G, 54, 32; 40/27.5; 74/414, 415, 416, 431–433, 457, 462; D11/95, 96, 108, 114

[56] References Cited

U.S. PATENT DOCUMENTS

| | | | |
|---|---|---|---|
| 1,455,289 | 5/1923 | Heene | 40/27.5 |
| 1,795,739 | 3/1931 | Shield | 194/4 G |
| 2,180,611 | 11/1939 | Schauweker | 194/4 G |
| 2,429,020 | 10/1947 | Friedman | 40/27.5 |
| 3,350,802 | 11/1967 | Segel | 40/27.5 |

*Primary Examiner*—Stanley H. Tollberg

*Attorney, Agent, or Firm*—Wolf, Greenfield & Sacks

[57] ABSTRACT

A token which cannot be easily counterfeited by inexpensive methods is disclosed, together with a simple token acceptance mechanism which will reject easily-made counterfeit tokens. The token is a disk-shaped object which has two sections along its axis. One section has a notched periphery and the second section has a smooth periphery. The notched section interacts with a pawl in the token acceptance mechanism and the smooth section interacts with an arm. The pawl and arm are interlocked so that only tokens that contain both the notched and the smooth section are accepted. Therefore tokens which are easily made by stamping or by turning on a lathe are not accepted by the mechanism.

21 Claims, 10 Drawing Figures

TOKEN AND ACCEPTANCE MECHANISM

This application is a continuation application of Ser. No. 321,721, filed Nov. 16, 1981, now abandoned.

FIELD OF THE INVENTION

The present invention relates to tokens and token acceptance mechanisms for use in token of slug operated vending machines, amusement machines, and access control devices such as turnstiles.

BACKGROUND OF THE INVENTION

During recent years increasing numbers of slug or token operated machines have been made and used. Many of these machines can be operated by means of coins. However, it is convenient to use a slug or token other than a coin so that the value of the services or goods dispensed by the machine can be changed without requiring a corresponding change in the acceptance mechanism of the machine.

Since automatic slug or token operated machines normally operate unattended, they are subject to operation by counterfeit tokens or slugs. In some circumstances, such as a large subway system, the amount of revenue lost through the use of counterfeit tokens is significant.

The most common methods of counterfeiting or copying slugs or tokens are stamping or machining on a lathe. These two methods can be utilized at a sufficiently low cost to make the counterfeiting operation economically feasible.

Various prior art arrangements have been used to prevent counterfeit coins from operating the associated machinery. In particular, tokens or slugs with various notched peripheries have been used in an attempt to distinguish the token or slug from common coins and to discourage counterfeiting. Unfortunately, notched designs are easily counterfeited by a stamping process. Other prior art designs have utilized a smooth periphery with various grooves located along the axis of the token. Specially shaped slots are then used in the acceptance mechanism to reject those tokens which do not have the corresponding grooves. Unfortunately this type of token is easily counterfeited by means of machining on a lathe.

It is therefore an object of the present invention to provide a token which is not easily counterfeitable by either stamping or machining.

It is another object of the invention to provide a simple, inexpensive and jam-proof mechanism for the acceptance of a token which is not easily counterfeitable.

It is a further object of the present invention to provide a token which is easily and inexpensively constructed and is compatible with many token acceptance mechanisms presently in use.

It is a still further object of the present invention to provide a token and token acceptance mechanism which can be used in addition to those token acceptance mechanisms already in use to provide additional protection against counterfeiting.

SUMMARY OF THE INVENTION

The foregoing problems are solved and the foregoing objects are achieved in an illustrative embodiment of the invention in which a token is provided which has two sections along its axis. One section contains a notched or serrated periphery and the second section contains a smooth periphery. When the inventive token enters the illustrative token acceptance mechanism, the notched section interacts with a pawl in the mechanism and moves the pawl to a predetermined position. The motion of the pawl unlocks an arm which is then moved by the smooth periphery section. Only tokens which contain both the notched and smooth sections will interact properly with both the pawl and the arm in order to be accepted by the mechanism. The illustrative acceptance mechanism can be used in conjunction with standard token acceptance mechanisms presently in use which detect token thickness and/or magnetic permeability in order to accept or reject in order to provide additional safety against counterfeiting.

DETAILED DESCRIPTION

Figure 1:
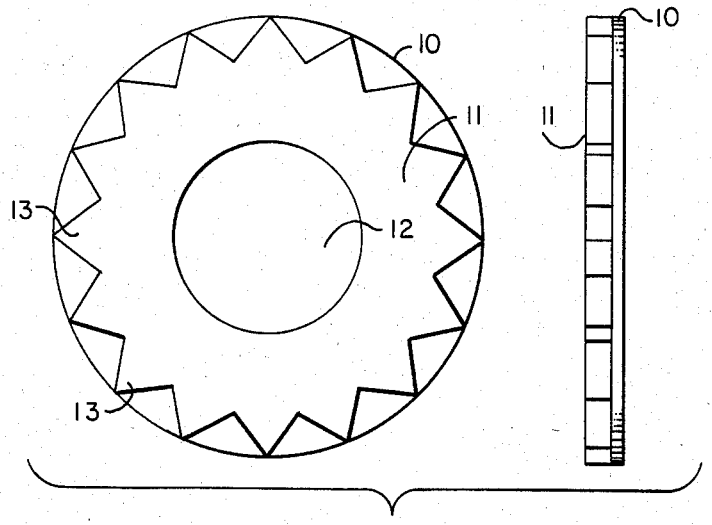
FIG. 1 of the drawing shows plan and side views of the illustrative two-section token.
Figure 5:
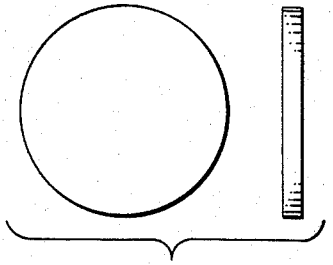
FIGS. 5 through 10 of the drawing are examples of counterfeit tokens which will not be accepted by the illustrative acceptance mechanism.

FIG. 1 of the drawing shows a slug or token made in accordance with an illustrative embodiment of the invention. The token is a disk-shaped object having two sections along its axis labeled 10 and 11 in FIG. 1. Section 11 has a notched periphery consisting of a number of teeth 13. In the embodiment shown, the teeth are shown arranged symmetrically around the periphery of the token. However, this is not necessary for the operation of the acceptance mechanism.

Section 10 has a smooth periphery. In the illustrative embodiment the diameter of this section is shown equal to the diameter of the outer periphery of teeth 13. However, this is not necessary for a proper operation of the token acceptance mechanism as will be hereinafter described. The token may have a circular, square or other geometrical cutout, 12 in the center. Such a cutout does not affect operation of the illustrative token acceptance mechanism and may be omitted if desired.

It will be noted from an inspection of the inventive token that, due to flange 10, the token cannot be easily duplicated by stamping. In addition, due to teeth 13, the token cannot be easily duplicated by means of machining on a lathe. One simple and inexpensive way of manufacturing such a token is by using a sintered metal process. In such a process metal for forming the token is provided in powdered form to a set of dies and subjected to high pressure. The pressure causes preliminary bonding of the metal particles to produce a preliminary part with the desired shape. The part is then heated under a controlled atmosphere to fuse the metal particles and produce the finished article. The sintering process is well known in the art of metal processing and will not be described further herein. One advantage of the sintering process is that a variety of metal powders may be mixed to make the final metallic composition from which the article is manufactured. Thus, it is possible to use a combination of magnetic and non-magnetic metals and metals of different densities in order to produce a token with the proper magnetic permeability and weight so that it will be accepted by presently-existing token acceptance mechanisms, as well as the inventive token acceptance mechanism. In this way the same token can be used with both the inventive token acceptance mechanism and conventional mechanisms placed in series to give added protection against counterfeiting. It is also possible to use a combination of metals with appropriate magnetic properties and densities so that the resulting token will have unique magnetic properties and/or a unique density. Such a token could not be counterfeited easily by means of tokens comprised of a single metal or metallic alloy.

Figure 2:
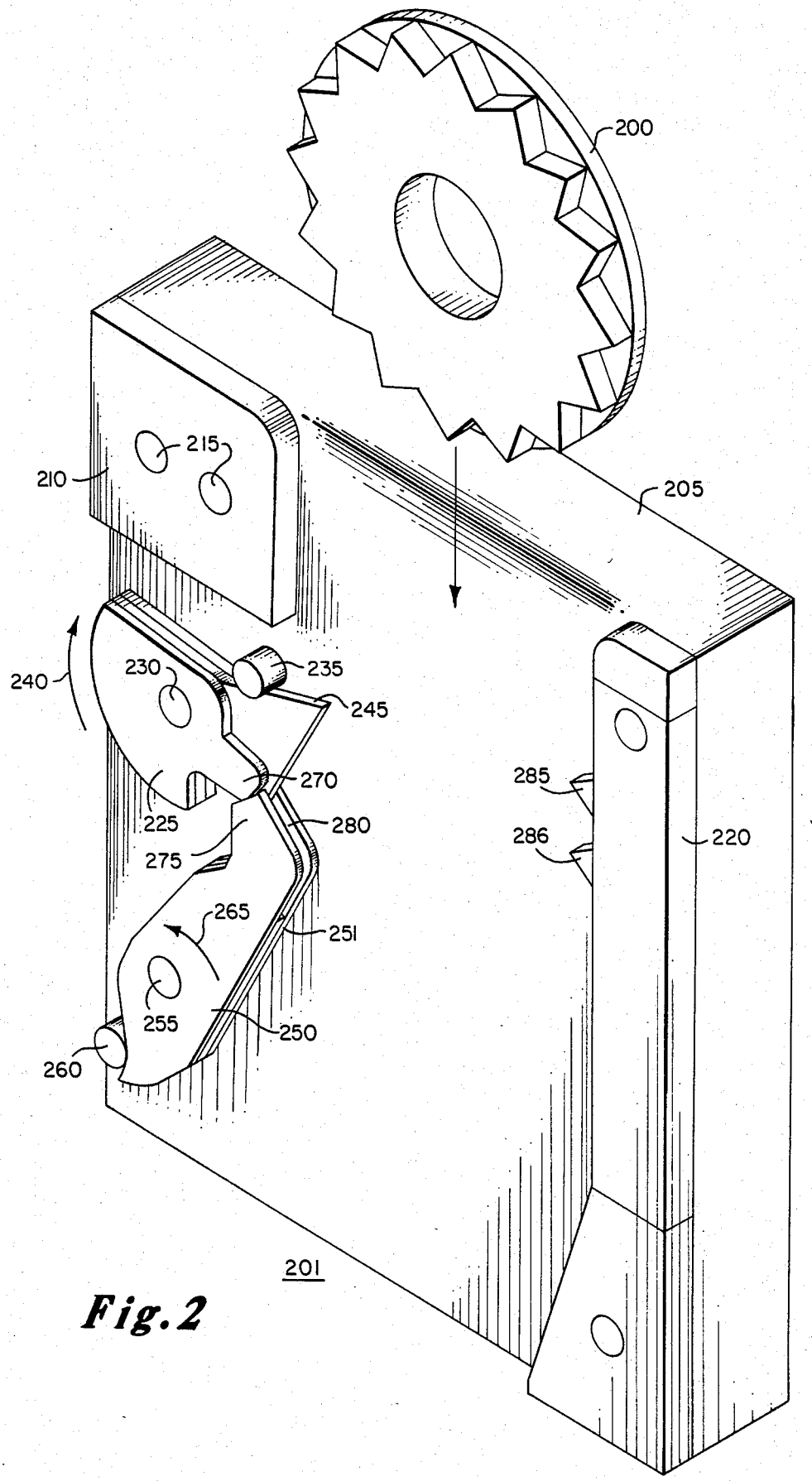
FIG. 2 of the drawing is a perspective view of the token and the illustrative acceptance mechanism.

Referring to FIG. 2, token 200 is shown entering the inventive acceptance mechanism 201. Mechanism 201 is provided with guide members 210 and 220 which position token 200 in proper position to interact with the pawl and arm mechanism as will be hereinafter described. Guide members 210 and 220 may be removably connected to the body 205 of the acceptance mechanism by means of screws, rivets or pins, (for example, screws 215) so that the guide members may be removed and replaced if they become damaged or worn. Guide member 220 contains a pair of teeth, 285 and 286, which together with tooth 245 of pawl 225 interact with the teeth of token 200 so that only tokens which have a notched periphery will be accepted. The illustrative acceptance mechanism is designed to be inserted into a housing surrounding an existing token acceptance mechanism. One wall of the housing together with members 210 and 220 and body 205 form a slot through which token 200 may drop. Alternatively, a cover (not shown) is removeably fastened to guide members 210 and 220 so that the cover, members 210 and 220 and the body 205 of the mechanism form a slot through which token 200 may drop. The cover has been omitted in FIG. 2 for clarity.

In particular, mechanism 201 has a pawl 225 and an arm 250. Pawl 225 rotates around pivot 230 and is weighted so that it normally rests against stop 235.

Arm 250 pivots around pivot 255 and is weighted so that it normally rests against stop 260. Pawl 225 and arm 250 are interlocked by means of projections 270 and 275. The interlocking is such, as will be hereinafter described in connection with FIGS. 3 and 4, that pawl 225 must be rotated in the direction of arrow 240 by means of the interaction of the token with the pawl before arm 250 can be rotated in the direction of arrow 265 by means of an interaction of the token and the arm. Both pawl 225 and arm 250 must be moved out of the way before the token is allowed to drop through mechanism 201 and actuate the associated token-operated device.

To allow token 200 to be inserted in either of its two axial orientations, arm 250 is composed of two identical sections 251 which cam interact with the flange of the token. Arm 250 also contains a slot 280 thereby allowing tooth 245 on pawl 225 to move into slot 280 when the pawl and arm interact as will be hereinafter described.

Figure 3:
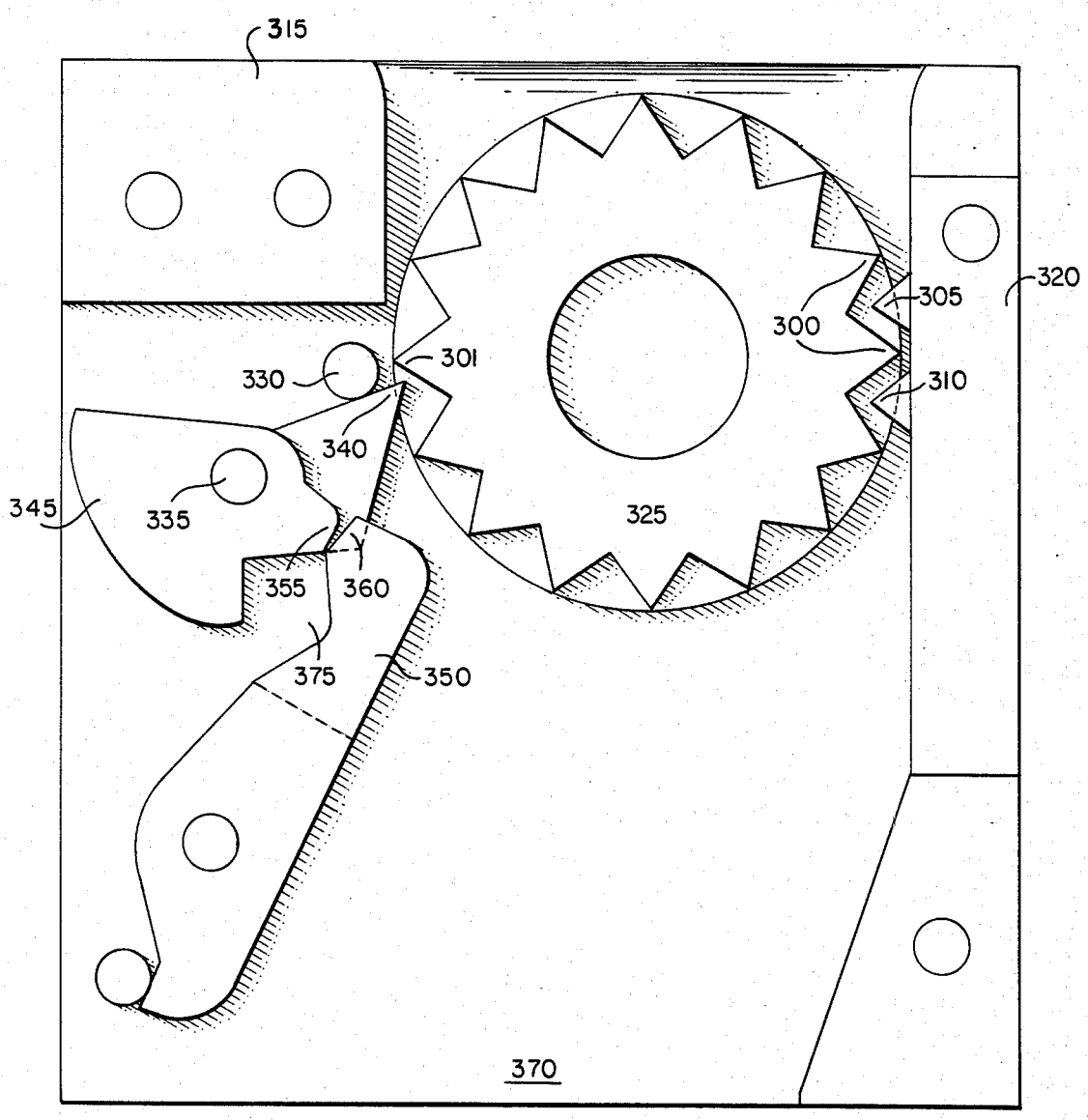
FIG. 3 of the drawing is a plan view of the token entering the acceptance mechanism.

FIG. 3 of the drawing shows token 325 entering token acceptance mechanism 370. As token 325 drops under the influence of gravity through mechanism 370 it is guided by guides 315 and 320 so that token teeth 300 engage stationary teeth 305 and 310. Teeth 305 and 310 are set in the center of guide 320 so that the flange portion of token 325 may pass either behind or in front of the teeth allowing the token to clear the mechanism.

Figure 4:
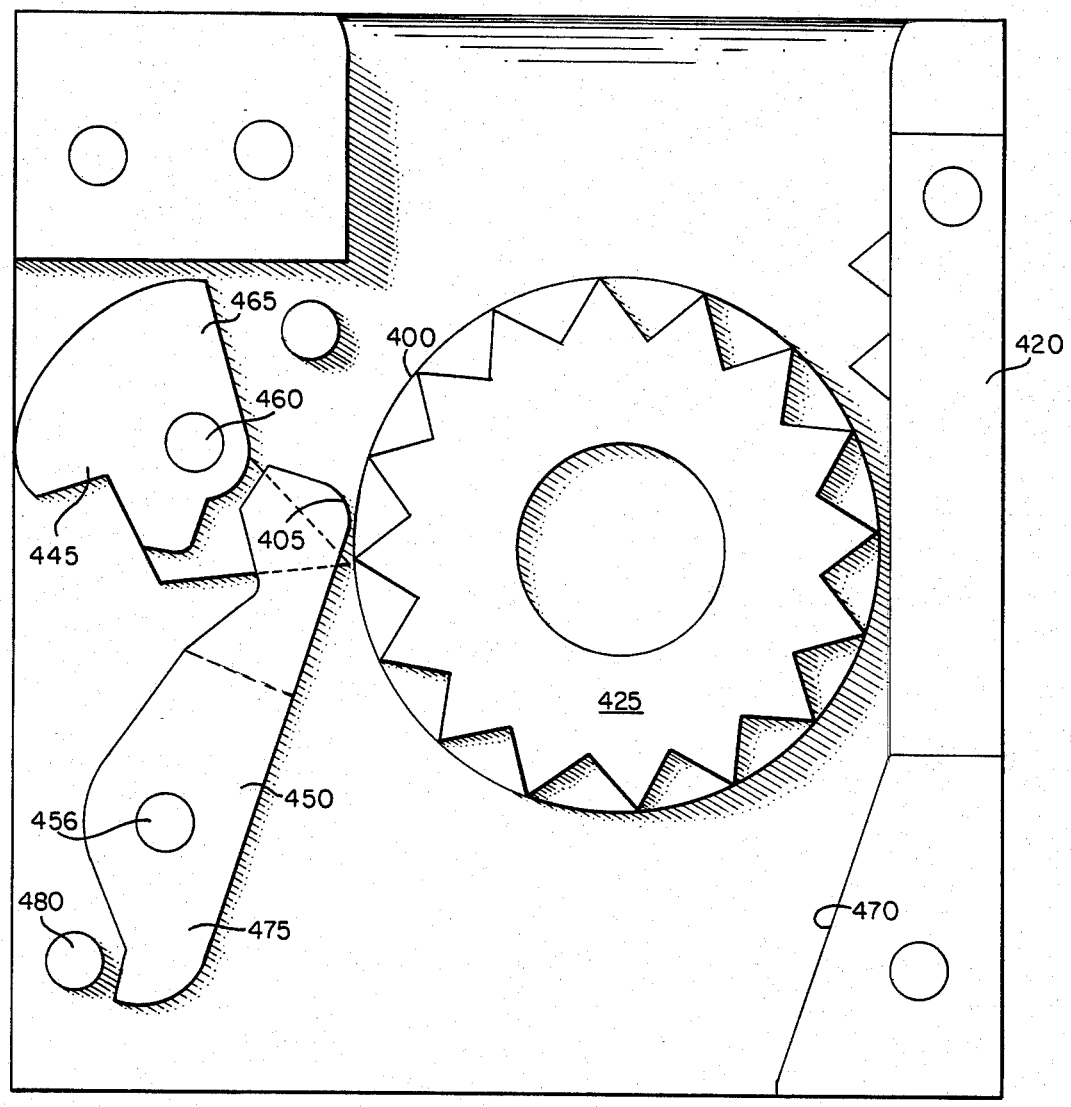
FIG. 4 of the drawing is plan view of the token interacting with the pawl and arm of the acceptance mechanism.

When teeth 300 engage teeth 305 and 310, the token is momentarily arrested on its right side thereby causing the left side to pivot against pawl 345, in turn causing tooth 301 to engage tooth 340 on pawl 345. Prior to the engagement of tooth 340 by tooth 301, pawl 345 rests against stop 330. Arm 350 is prevented from rotating by the interaction of projection 355 and projection 360. However, as token 325 moves downward, tooth 301 presses against tooth 340 causing pawl 345 to pivot around its pivot 335 into its position as shown in FIG. 4. As a result of the pivoting action, projection 355 moves into recess 375, releasing arm 350.

Referring to FIG. 4, as token 425 continues its downward movement through the mechanism, flange portion 400 of the token bears against the projecting portion 405 of arm 450 causing it to pivot around pivot 456 and move to the left.

With both pawl 445 and arm 450 moved to their release positions, token 425 is free to fall through the mechanism. As it does so arm 450 becomes free to fall back into its resting position. Arm 450 is weighted and pivoted to move under its own weight into its resting position after the token passes. When arm 450 moves into its resting position, pawl 445 is released and also falls back into its resting position under its own weight. The return of the mechanism into its resting state is also assisted when the token falls through the mechanism and strikes the inclined portion 470 of guide 420. Inclined portion 470 is used to line the token up with any additional pre-existing acceptance mechanism which may be placed in series with the inventive mechanism. However, portion 470 also causes the falling token to move towards the left. The flange portion of the token then strikes edge 475 of arm 450 causing it to move to the left against stop 480. This action releases pawl 445 which then pivots around pivot 460 (due to the weight of portion 465) bringing the mechanism into its resting position, ready for another token.

FIGS. 5 through 10 of the drawing show examples of easily manufactured counterfeit token which will be rejected by the mechanism. In particular, FIG. 5 of the drawings shows a simple, round token which can be produced easily by stamping. Since it does not have a notched periphery, however, such a token when entering the acceptance mechanism when shown in FIG. 2 will jam against teeth 285 and 286 and either guide 210 or stop 235.

Figure 6:
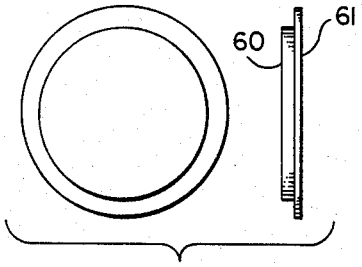

FIG. 6 of the drawing shows a counterfeit token which may be easily manufactured on a lathe. It consists of two sections 60 and 61 along its axis, both of which have smooth peripheries. Although the diameter of section 60 may be small enough to clear the mechanism teeth, pawl 245 will not be operated. Section 61 could normally operate arm 250 but since pawl 245 and arm 250 are interlocked, the counterfeit token jams against arm 250.

Figure 7:
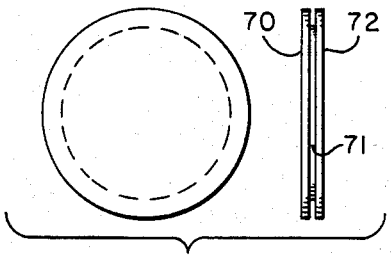

FIG. 7 of the drawing shows a counterfeit token which has three sections, 70, 71 and 72, along its axis. The diameter of section 71 may be small enough to clear the mechanism teeth, however pawl 245 will not be operated. Sections 70 and 71 could normally operate arm 250 but since pawl 245 and arm 250 are interlocked, the counterfeit token jams against arm 250 in the same manner as the token shown in FIG. 6.

Figure 8:
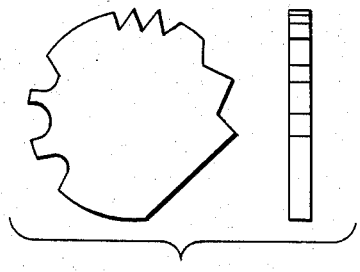

FIG. 8 of the drawing shows a token with a notched periphery which can be easily produced by stamping. In this counterfeit token the notched periphery may be able to interact with the teeth in order to operate pawl 225. However, since there is no smooth flanged portion of the token, arm 250 is not moved out of the way and therefore jams the token before it can move through the mechanism.

Figure 9:
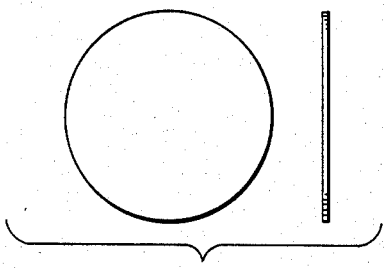

FIG. 9 of the drawing shows a counterfeit token which has a reduced thickness. The reduced thickness allows the token to clear the teeth 285, 286 and 245 and rest against arm 250. However, since pawl 225 is not operated, the interlocking arrangement between pawl 225 and 250 prevents arm 250 from operating and therefore the token does not clear the acceptance mechanism.

Figure 10:
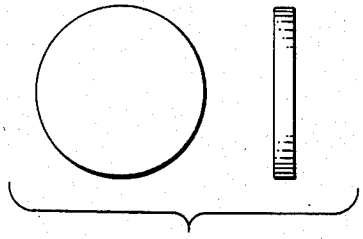

FIG. 10 of the drawing shows a standard thickness token which has a reduced diameter. A sufficiently reduced diameter might allow the token to clear through the acceptance mechanism. However, such a token is easily rejected by a standard acceptance mechanism and thus a combination of a standard acceptance mechanism and the illustrative token acceptance mechanism prevents the acceptance of such a token.

Although a specific illustrative embodiment of the inventive token and acceptance mechanism have been shown, other modifications and variations within the scope of the invention will be obvious to those skilled in the art. For example, the notched and smooth sections of the token may be of unequal diameters and the notches need not be spaced at equal intervals around the periphery of the token.

What is claimed is:

1. In combination, a disk-shaped token having a first section and a second section disposed perpendicularly to the axis of said token, said first section having a notched periphery and said second section layer having a smooth periphery, and a token acceptance mechanism comprising:

means for defining a slot in said token acceptance mechanism through which said token moves, means responsive to said notched periphery for enabling said acceptance mechanism, comprising a plurality of teeth, including at least one fixed tooth located on one side of said slot and at least one movable tooth on the other side of said slot, whereby a token with a notched periphery entering said token acceptance mechanism causes movement of said movable tooth, and means, when enabled, responsive to said smooth periphery for accepting the token, said acceptance means comprising a movable arm, said arm being responsive to the movement of said movable tooth and to said smooth periphery for moving in a direction to allow said token to move through said token acceptance mechanism, whereby only tokens having both a notched periphery section and a smooth periphery section will be accepted by the token acceptance mechanism.

2. The combination according to claim 1 wherein said movable tooth is attached to a rotatable pawl and said pawl has a projection that bears against said arm and said arm has a recess located therein to accept said projection on said pawl when said pawl has been moved by the passage of a token having a notched periphery.

3. The combination according to claim 2 further comprising means for resetting said mechanism after said token has passed through said mechanism.

4. A token acceptance mechanism for use with a disk-shaped token having a first and a second section disposed perpendicularly to the axis of said token, said first section having a notched periphery and said second section having a smooth periphery, said token acceptance mechanism comprising:

means for defining a slot in said token acceptance mechanism through which said token moves, means responsive to said notched periphery for enabling said acceptance mechanism, comprising a plurality of teeth, including at least one fixed tooth located on one side of said slot and at least one movable tooth on the other side of said slot, whereby a token with a notched periphery entering said token acceptance mechanism causes movement of said movable tooth, and means, when enabled, responsive to said smooth periphery for accepting the token, comprising a movable arm, said arm being responsive to the movement of said movable tooth and to said smooth periphery for moving in a direction to allow said token to move through said token acceptance mechanism, whereby only tokens having both a notched periphery section and a smooth periphery section will be accepted by the token acceptance mechanism.

5. The token acceptance mechanism according to claim 4 wherein said movable tooth is attached to a rotatable pawl and said pawl has a projection that bears against said arm and said arm has a recess located therein to accept said projection on said pawl when said pawl has been moved by the passage of a token having a notched periphery.

6. The token acceptance mechanism according to claim 5 further comprising means for resetting said mechanism after said token has passed through said mechanism.

7. The token acceptance mechanism according to claim 6 wherein said means for resetting said mechanism is responsive to the passage of said token through said mechanism.

8. A token for use in a token-operated vending machine or turnstyle, said token being comprised of two circular planar surfaces separated by a generally circular rim, said rim being comprised of a first section having a smooth periphery immediately adjacent to one edge of said rim and a second section having a maximum diameter equal to or less than the diameter of said first section and having a plurality of notches extending inwardly from the periphery of said second section forming a plurality of teeth on said periphery.

9. A token according to claim 8 wherein the diameter of said first section is equal to the maximum diameter of said second section.

10. A token according to claim 8 wherein the notches in said notched periphery are triangularly-shaped.

11. A token according to claim 10 wherein some of the triangularly-shaped notches are positioned so that one side of the triangle lies along the periphery of said second section and the angle of the triangle opposite said one side is positioned toward the center of said second section.

12. A token according to claim 11 wherein the notches in the periphery of said second section are arranged substantially adjacent to each other forming a plurality of triangular teeth along said periphery of said second section.

13. A token according to claim 8 wherein the notches in the periphery of said second section are arranged symmetrically around the axis of said token.

14. A token according to claim 8 wherein the width of said first section comprises at least one third of the entire width of said token.

15. A token for use in a token-operated vending machine or turnstyle, said token being generally disk-shaped and having two parallel, substantially planar, faces, said token being comprised of a first generally disk-shaped section having at least one substantially planar face and a second generally disk-shaped section, said sections each being disposed perpendicularly to the axis of said token, said first section having a smooth periphery, said planar face of said section forming one face of said token, said second section having a plurality of teeth spaced around the periphery of said section, and a maximum diameter, including said teeth, equal to or less than the diameter of said first section.

16. A token according to claim 15 wherein the diameter of said first section is equal to the maximum diameter of said second section.

17. A token according to claim 15 wherein said teeth are triangular.

18. A token according to claim 17 wherein some of the triangularly teeth are positioned with the point of the triangle facing the periphery of said section.

19. A token according to claim 18 wherein said teeth are arranged substantially adjacent to each other.

20. A token according to claim 15 wherein said teeth are arranged symmetrically around the axis of said token.

21. A token according to claim 15 wherein the width of said first section comprises at least one third of the entire width of said token.

* * * * *